United States Patent [19]

Tajima et al.

[11] 4,045,265

[45] Aug. 30, 1977

[54] COMBINED APPLICATION PROCESS OF THERMAL INSULATION AND BUILT-UP ROOFING OR WATERPROOFING

[75] Inventors: Eiichi Tajima; Kaname Yamamoto, both of Tokyo, Japan

[73] Assignee: Tajima Roofing Co., Ltd., Tokyo, Japan

[21] Appl. No.: 662,371

[22] Filed: Mar. 1, 1976

[30] Foreign Application Priority Data

Mar. 18, 1975 Japan ..... 50-31817

[51] Int. Cl.[2] ..... E04B 2/02

[52] U.S. Cl. ..... 156/71; 52/746; 62/DIG. 13; 428/310; 428/315; 428/489; 156/337; 156/338

[58] Field of Search ..... 156/71, 337, 338; 428/310, 315, 141, 149, 489; 62/DIG. 13; 52/746

[56] References Cited

U.S. PATENT DOCUMENTS

| | | | |
|---|---|---|---|
| 3,211,597 | 10/1965 | Sheahan | 156/71 |
| 3,373,074 | 3/1968 | D'Eustachio et al. | 156/71 |
| 3,470,016 | 9/1969 | Biles et al. | 428/315 |
| 3,502,539 | 3/1970 | MacPhail | 428/315 |
| 3,726,754 | 4/1973 | Coglianese et al. | 156/71 |

*Primary Examiner*—Edward G. Whitby

*Attorney, Agent, or Firm*—Woodhams, Blanchard and Flynn

[57] ABSTRACT

A novel combined application process of thermal insulation and built-up roofing or waterproofing is provided. In this application process, a foamed thermoplastic thermal insulating material is bonded with a membrane having a tacky compound layer on one surface thereof so that the tacky compound layer is in close contact with the foamed thermoplastic material, without causing any damage due to heating, and a built-up roofing or waterproofing is formed on the other surface of the membrane according to the conventional application process.

11 Claims, No Drawings

COMBINED APPLICATION PROCESS OF THERMAL INSULATION AND BUILT-UP ROOFING OR WATERPROOFING

This invention relates to an application process for manufacturing a built-up bituminous roofing or waterproofing and thermal insulation assembly, by combining a bituminous roofing or waterproofing application with a thermal insulating on the tops of buildings and the like.

The terms "bituminous" and "bitumen" as used throughout this specification may be replaced with the term "asphalt".

Heretofore, roofing or waterproofing membrane layers have been generally applied on roof slabs by using the well-known conventional type bituminous roofing or waterproofing technique in order to prevent leaking of rainwater through the roofs of buildings and the like. Further, recently, it has become a general practice that thermal insulating materials are inserted between the roof slabs and said bituminous roofing or waterproofing layers in order to make the inside of the buildings comfortable and to protect the buildings.

Materials used for the thermal insulation include natural organic materials such as, for example, a cork board and a fiberboard; inorganic materials such as, for example, a foamed glass, a perlite board, a rock wool and a fiberglass board; and synthetic polymeric materials such as, for example, a foamed polystyrene, a foamed polyethylene, a foamed polyvinyl chloride, a foamed phenolic resin, a rigid polyurethane foam and the like. Such various kinds of materials are practically used as a preformed article in the form of a board.

The above mentioned materials have both advantages and defects, due to their own characteristics, as materials for thermal insulation use and, thus, there is no superior thermal insulating material up to the present time. Of these materials, foamed thermoplastic resin boards such as polystyrene, polyethylene, polyvinyl chloride and the like, are well-known as the most preferable materials for thermal insulation combined with roofing or waterproofing for the following reasons. That is: (1) their thermal insulating property is excellent; (2) their water absorption property is very small and, therefore, there is little possibility of a decrease in thermal insulating property due to water absorption; (3) their mechanical strength is good; (4) it is difficult to rot them or to debase their properties, and; (5) the costs of these materials are relatively cheap. However, these foamed thermoplastic materials naturally have a poor heat resistance, so that they have the serious problem of easily suffering fatal damage due to the heat of molten bitumen when the foamed thermoplastic materials are applied in combination with bituminous roofing or waterproofing.

As is well-known, in conventional bituminous roofing or waterproofing work the formation of the bituminous built-up roofing or waterproofing layer is preformed as follows. Molten bitumen heated to a temperature of approximately 250° C or more is coated or poured onto a substrate and, then, bituminous roofing membranes are spread over the bitumen layer on the substrate. The above two steps are generally repeated, whereby a roofing or waterproofing layer comprising bitumen layers and roofing membranes, which are alternately laminated one after the other, is formed on the substrate.

On the other hand, in a recently developed combined application of thermal insulation and built-up roofing or waterproofing, it is generally accepted that the thermal insulating layer is inserted between a roof slab and a roofing or waterproofing layer. In this case, the thermal insulating material is usually bonded with molten bitumen onto the roof slab and, then, the roofing or waterproofing layer is formed on it in the manner as mentioned above.

In the thermal insulating material bonding step, if the thermal insulating material is applied onto the bitumen layer after the molten bitumen, having a high temperature, coated on the roof slab is allowed to cool to such a temperature that it has a minimum necessary adhesion property, it is possible not to remarkably damage the thermal insulating material having the poor heat resistance mentioned above.

In the next application step of a roofing or waterproofing layer on the thermal insulating material, the molten bitumen, which serves as a bonding agent, is directly applied onto the thermal insulating material according to conventional practice. However when a thermal insulating material having a poor heat resistance, such as a foamed thermoplastic material, is used, the portion of the thermal insulating material contacted with the molten bitumen having a high temperature immediately melts and shrinks. This is a fatal problem in the conventional application process.

Various attempts have been made to obviate the above-mentioned problems. For instances, the application of the bitumen onto the thermal insulating material is carried out at a relatively low temperature by using a bitumen compound having a low softening point blended with, for example, paraffin wax having a low melting point; or the application of the bitumen onto the thermal insulating material is carried out after hot molten bitumen is applied to the roofing or waterproofing membrane and is allowed to cool to such a minimum temperature that the bitumen still has a necessary adhesion property. However, in the former case, enough blending for decreasing the softening point results in problems with respect to the waterproofing function of the bitumen such as deleterious change of the properties of bitumen itself, for example, deterioration of the adhesive property and the durability. Contrary to this, in the latter case, the complicated application work is accompanied by a decrease in working efficiency and, further, there is some risk that the process will damage the thermal insulating material or result in incomplete bonding of the thermal insulating material with the bitumen due to the difficulty of manual control, especially the delicate temperature control of the coated bitumen layer to be cooled, the reliability of which control depends largely on the skill and intuition of the workers.

Thus, heretofore, the combined application process of bituminous roofing or waterproofing with foamed thermoplastic resin materials, which have a relatively preferable property for thermal insulation, has not been performed satisfactorily.

The main objects of the present invention are to obviate the aforementioned problems in the conventional combined application process of thermal insulation and built-up roofing or waterproofing and to provide a novel combined application process of thermal insulation and built-up roofing or waterproofing.

Other objects and advantages of the present invention will be apparent from the following description.

In accordance with the present invention, there is provided a combined application process for manufacturing a built-up bituminous roofing or waterproofing and thermal insulation assembly comprising the steps of:

a. placing a base sheet having on one surface thereof a compound layer on a foamed thermoplastic resin board so that the compound layer is in close contact with the foamed thermoplastic resin board, and compound layer consisting essentially of a substantially pressure-sensitive self-adhesive composite material, and;

b. coating the other surface of the base sheet with molten bitumen.

The base sheet employed in the present combined application process includes a sheet-like material composed of fibers, such as paper, felt, woven or nonwoven fabric, with or without impregnation with bitumen, metallic thin sheet or foil, synthetic resin film or sheet, those coated with bitumen and various conventional bituminous roofing membranes.

The substantially pressure-sensitive self-adhesive composite material covering one surface of the base sheet is one of those which have a pressure-sensitive self-adhesive property at ordinary ambient temperature or at a slightly heated temperature therefrom. Such composite material can be composed of at least two components selected from the group consisting of mineral oil, rubber, resin and animal or vegetable oil. Such mineral oil includes, for example, natural asphalt, petroleum bitumen, tar, pitch and other heavy mineral oils. Said rubber includes, for example, natural rubber or synthetic rubber such as styrene-butadiene rubber, acrylonitrile-butadiene rubber, chloroprene rubber, butadiene rubber, isoprene rubber, butyl rubber, ethylene-propylene rubber, ethylene-propylene-diene mar, polyisobutylene, chlorinated polyethylene and the like. Said resin includes natural or synthetic resin such as, for example, rosin or its derivatives (e.g. estergum), tall oil, cumaron-indene resin, various petroleum resins, polyolefin (e.g. polybutene) and the like. Said animal or vegetable oil includes animal or vegetable oils and animal fats such as, for example, linseed oil, tung oil, sesame oil, cotton seed oil, soyabean oil, olive oil, castor oil, fish oil, whale oil, beef tallow and the like. The composite material can be any combination of two or more of the four components mentioned above. Further, so long as said two or more components are present, two or more species belonging to the same component can be incorporated into the composite material. For optimum result, it is preferred that said composite material is essentially composed of 5–95% by weight of the mineral oil, 3–80% by weight of the rubber, 2–60% by weight of the resin and 0–40% by weight of the animal or vegetable oil.

The base sheet having the compound layer on one surface thereof is generally covered, over said one surface, with release sheet which can be easily and readily removed from the compound layer by manually peeling it therefrom at ordinary ambient temperature. Such release sheet includes conventional sheet materials which are generally and widely used for covering and protecting pressure-sensitive self-adhesive surfaces, for example, paper, film and the like coated or impregnated with synthetic resins having high releasing property such as silicone resin, fluorine-containing resin and the like. The release sheet is removed from the compound layer surface before the base sheet, having the compound layer on one face thereof, is used at construction site. This release sheet is used for facilitating the handling of the base sheet having the compound layer on one surface thereof.

At the construction site, the base sheet having the compound layer on one surface thereof is placed on said foamed thermoplastic resin board so that the compound layer is in close contact with the foamed thermoplastic resin board after the release sheet is removed from the compound layer surface. Then the other surface of the base sheet, which surface has no compound layer, is coated with hot molten bitumen generally having a temperature of 200° C or more in accordance with the conventional bituminous roofing application technique. After that, a conventional bituminous roofing membrane may be laid over the bitumen layer thereover as occasion demands. The steps of the coating of the molten bitumen and the laying of the bituminous roofing membrane can be further repeated alternately as many times as occasion demands.

In this way, the other surface of the base sheet is directly heated, so that the compound layer of the base sheet is indirectly heated through the base sheet by heat conduction to thereby raise the temperature of the compound layer to some extent. This rise in the temperature of the compound layer by indirect heating increases the adhesion property of the compound which is pressure-sensitive self-adhesive at ordinary ambient temperature or a slightly heated temperature. Consequently, the foamed thermoplastic resin board, which is a thermal insulating material, is sufficiently bonded to the base sheet through the compound layer, the tackiness of which is enhanced by the temperature rise, without causing any harmful damage.

Thus, the present combined application process ensures bonding of the built-up bituminous roofing or waterproofing layer and the thermal insulation board having a low heat resistance by only using said base sheet having the specified compound layer on one surface thereof as a bonding medium.

In accordance with the present combined application process, the step consisting essentially of applying molten bitumen directly or indirectly to the thermal insulating material can be completely omitted.

The present combined application process also has an advantage with respect to maintenance of the roofing or waterproofing layer, which advantage cannot be expected in the conventional application process. That is, in the conventional application process, since the thermal insulation boards and the bituminous roofing or waterproofing layer are firmly bonded to each other by the bitumen layer, the roofing or waterproofing layer is directly subjected to repeated stress at the joints of the thermal insulation boards, which stress is derived from expansion and contraction of the boards themselves caused by the rise and fall of the temperature. Because of this, in the conventional process the roofing or waterproofing layer are finally broken at the joints due to fatigue as the time proceeds. Contrary to this, according to the present combined application process, since the thermal insulation boards and the bituminous roofing or waterproofing layer are bonded with the compound layer consisting essentially of the substantially pressure-sensitive self-adhesive composite material, a substantial portion of the repeated stress derived from the movement of the thermal insulation boards is absorbed into the composite material. This is because the composite material having high plasticity and/or flowability can easily slip between said layer and boards. Thus, the fatigue failure problem of the roofing or waterproofing layer which occurs as time proceeds, can be substantially solved and the durability thereof is remarkably increased.

The present combined application process of thermal insulation and built-up roofing or waterproofing has the still further advantages of increased efficiency due to simplification of the application process and increased reliability due to its being independent of the skill and intuition of a worker, compared to the conventional application process. Further, the present combined application process can be applied to not only the tops of the buildings, but also surrounding walls, ceilings and floors of refrigerating warehouses and the like.

The present invention will now be illustrated by, but by no means limited to, the following example.

EXAMPLE

Non-woven fabric of 160 g/m$^2$, prepared from non-crimped polyvinyl alcohol fiber having a fineness of 2 denier and a mean length of 150 mm, was impregnated with molten blown bitumen, having a softening point of 100° C and a penetration degree of 40° at 25° C. Then, both surfaces of the fabric thereof were coated, respectively, with said molten blown bitumen in such an amount that a thickness of the coated bitumen layer reached approximately 0.8 mm and then one surface thereof was covered with mineral sand. The other surface of the bitumen-coated fabric thus obtained was coated to a thickness of approximately 0.4 mm with a tacky compound consisting essentially of 25 parts by weight of SBR, 10 parts by weight of process oil, 5 parts by weight of tall oil and 60 parts by weight of straight-trun bitumen. After that the surface of the compound layer was covered with a release paper subjected to silicone resin treatment. The resultant membrane was wound up into rolls.

A concrete slab of a roof was coated with a primer consisting of a bitumen solution and then, after drying, coated to a thickness of approximately 1 mm with molten blown bitumen heated to approximately 200° C. The coated layer was then allowed to cool. Laid over the bitumen layer, which still had some tackiness, were foamed polystyrene boards which had a thickness of 40 mm and had been produced by an extrusion molding process. The membrane having the tacky compound layer prepared above was unrolled and placed, after removing the release paper therefrom, on the foamed polystyrene boards so that the tacky compound layer was in contact with the foamed polystyrene boards. The surface of the membrane was then coated to a thickness of approximately 1 to 2 mm with molten bitumen having a temperature of approximately 270° - 280° C and a conventional bituminous roofing membrane was immediately laid thereon. The coating of the blown bitumen and the laying of the roofing membrane was alternately repeated in the same manner as described above to form a roofing layer composed of four bituminous roofing membranes.

It was observed, by checking a portion cut from the thermal insulation and waterproofing assembly thus obtained, that the foamed polystyrene board and the bituminous roofing membrane was entirely and completely bonded with said tacky compound. Further, no damage to the foamed polystyrene board due to the heating could be observed.

What we claim is:

1. A combined application process for manufacturing a built-up bituminous roofing or waterproofing and thermal insulation assembly comprising the steps of:

a. placing a base sheet having a compound layer on one surface thereof, onto one surface of a foamed thermoplastic resin board whose other surface is adhered to a substrate surface so that the compound layer is in close adhering contact with said one surface of the foamed thermoplastic resin board, said compound layer consisting essentially of a substantially pressure-sensitive self-adhesive composition, and;

b. coating the other surface of the base sheet with hot molten bitumen.

2. The combined application process as claimed in claim 1, wherein said process comprises the further step of laying a bituminous roofing membrane on the molten bitumen layer.

3. The combined application process as claimed in claim 2, wherein the two steps of coating the molten bitumen and laying the bituminous roofing membrane are repeated alternately to form a built-up roofing.

4. The combined application process as claimed in claim 1, wherein said base sheet is selected from the group consisting of a non-impregnated fibrous sheet, a fibrous sheet impregnated with bitumen, a synthetic resin film or sheet, a metal foil or thin sheet, a sheet coated with bitumen and a conventional bituminous roofing membrane.

5. The combined application process as claimed in claim 1, wherein said substantially pressure-sensitive self-adhesive composition is composed of at least two components selected from the group consisting of mineral oil, rubber, resin and animal or vegetable oil.

6. The combined application process as claimed in claim 5, wherein said mineral oil component is at least one substance selected from the group consisting of natural asphalt, petroleum bitumen, tar, pitch and other mineral heavy oils.

7. The combined application process as claimed in claim 5, wherein said rubber component is at least one substance selected from the group consisting of natural rubber and synthetic rubbers.

8. The combined application process as claimed in claim 5, wherein said resin component is at least one substance selected from the group consisting of natural resins and synthetic resins.

9. The combined application process as claimed in claim 5, wherein said animal or vegetable oil is at least one substance selected from the group consisting of vegetable oils and animal oils and fats.

10. The combined application process as claimed in claim 5, wherein said composition is composed essentially of 5-95% by weight of said mineral oil, 3-80% by weight of said rubber, 2-60% by weight of said resin and 0-40% by weight of said animal or vegetable oil.

11. A process for manufacturing a combined, built-up, bituminous roofing or waterproofing and thermal insulation assembly, utilizing a base sheet having the entirety of one surface thereof covered with a compound coating layer consisting essentially of a pressure-sensitive self-adhesive composition that possesses high tackiness at ambient temperature, said compound layer being covered by a release paper having a release surface in releasably adhering contact with the outer surface of said compound layer and the other surface of said base sheet being free of said compound layer, comprising the steps of:

adhering, onto a wall of a building, foamed thermoplastic resin board means to form a thermal insulation layer on said wall, the outer surface of said board means being exposed;

removing the release sheet from said compound layer of said base sheet to expose said compound layer and then placing said base sheet onto the exposed outer surface of said foamed thermoplastic resin board means with said compound layer being in direct face-to-face adhering contact with said outer surface of said board means to form a substantially waterproof joint therebetween; and then coating said outer surface of said base sheet with a layer of molten roofing bitumen.

* * * * *